United States Patent [19]

Sarda et al.

[11] 4,072,193

[45] Feb. 7, 1978

[54] PROPPING AGENT AND METHOD OF PROPPING OPEN FRACTURES IN THE WALLS OF A BORED WELL

[75] Inventors: Jean-Paul Sarda; Pierre Le Tirant, both of Rueil-Malmaison, France

[73] Assignee: Institut Francais du Petrole and Societe Europeenne de Produits Refractaires, France

[21] Appl. No.: 668,480

[22] Filed: Mar. 19, 1976

[30] Foreign Application Priority Data

Mar. 19, 1975 France ..... 75 08827

[51] Int. Cl.[2] ..... E21B 43/26

[52] U.S. Cl. ..... 166/280

[58] Field of Search ..... 166/280

[56] References Cited

U.S. PATENT DOCUMENTS

| | | | |
|---|---|---|---|
| 3,373,815 | 3/1968 | Kiel et al. | 166/280 |
| 3,437,148 | 4/1969 | Colpoys | 166/280 UX |
| 3,701,383 | 10/1972 | Richardson et al. | 166/280 |
| 3,976,138 | 8/1976 | Colpoys et al. | 166/280 |

*Primary Examiner*—Ernest R. Purser

*Attorney, Agent, or Firm*—Craig and Antonelli

[57] ABSTRACT

A propping agent for fractures produced in the walls of a bored well comprising a granular or particulate product containing on the basis of its oxide content up to 85% by weight zirconium oxide ($ZrO_2$) in a quantity which is such that the weight ratio of $ZrO_2/SiO_2$ is equal to or greater than 1.5, alumina ($Al_2O_3$) in a quantity which is such that the weight ratio $Al_2O_3/SiO_2$ is between 0 and 1.5 and sodium oxide ($Na_2O$) in a quantity which is such that the weight ratio $Na_2O/SiO_2$ is between 0 and 0.04.

15 Claims, 2 Drawing Figures

PROPPING AGENT AND METHOD OF PROPPING OPEN FRACTURES IN THE WALLS OF A BORED WELL

The present invention relates to an improvement to methods of fracturing the walls of a bored well, this improvement making it possible to retain the efficacy of these methods in very deep strata (the depth can exceed 4,000 meters).

More specifically, the invention relates to a method of propping open fractures produced in the walls of a bored well passing through geological formations.

As is known, fracture stimulation of the geological strata surrounding a bored well, is effected by fracturing the walls of the well, for example, by injecting a pressurized hydraulic fluid in the region of the formation to be stimulated and then pumping into the fractures or breaks, a fluid containing solid grains, referred to as "propping agents".

The function of these supporting agents is very basic as they are used to keep open each fracture, which is thus produced. After ceasing the injection of the pressurized fluid which has been used to produce the fracture, if, for example, the hydraulic fracturing method is used, the fluid contained in the break filters through the walls of the latter and the geostatic stresses are exerted on the propping agent.

More specifically, if $\sigma$ is the "total" stress exerted by the rocks, and if $p$ is the pressure of the fluid in the fracture and in these rocks, the propping agent is exposed to the so-called "effective" stress $(\sigma - p)$.

In deep wells, particularly when the geological stratum has been very "productive", i.e., when the pressure $p$ is low, the effective stress reaches values of at least 400 bars and, in certain cases, can even exceed 700 bars.

The propping agents which have been used most commonly hitherto are, in order of increasing importance: fragments of nut shells, "high resistance" glass balls, sands having a given granulometry.

The mechanical resistance of nut shells is very inadequate for the stresses cited above. In addition, the mechanical properties of this material do not prove reliable in the course of time owing to its changeability in the underground temperature and salinity conditions.

The performance of sands and glass balls can be judged from tests carried out by certain specialized laboratories.

Figure 1:
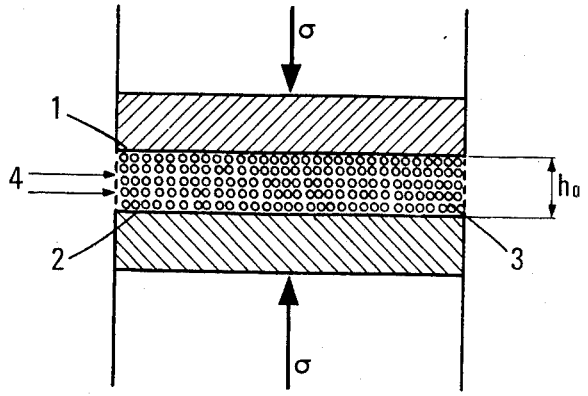

In these tests, which are represented, in principle, in the diagram shown in FIG. 1, the fracture is simulated by two plane faces 1 and 2, disposed parallel and spaced apart by a distance $h_o$ corresponding to the initial fracture depth before the effective stress $(\sigma - p)$ is applied.

The propping agent 3 is disposed in this fracture. The two plane faces exert an arbitrarily variable stress $\sigma - p$ on this propping agent by suitable means. In the case of the values $\sigma - p$ which are of interest to the experimenter, a fluid 4 having a known viscosity is circulated in the break. The permeability $k$ of the break and its conductivity $kh$, can thus be measured, $h$ constituting the depth of the break.

Figure 2:
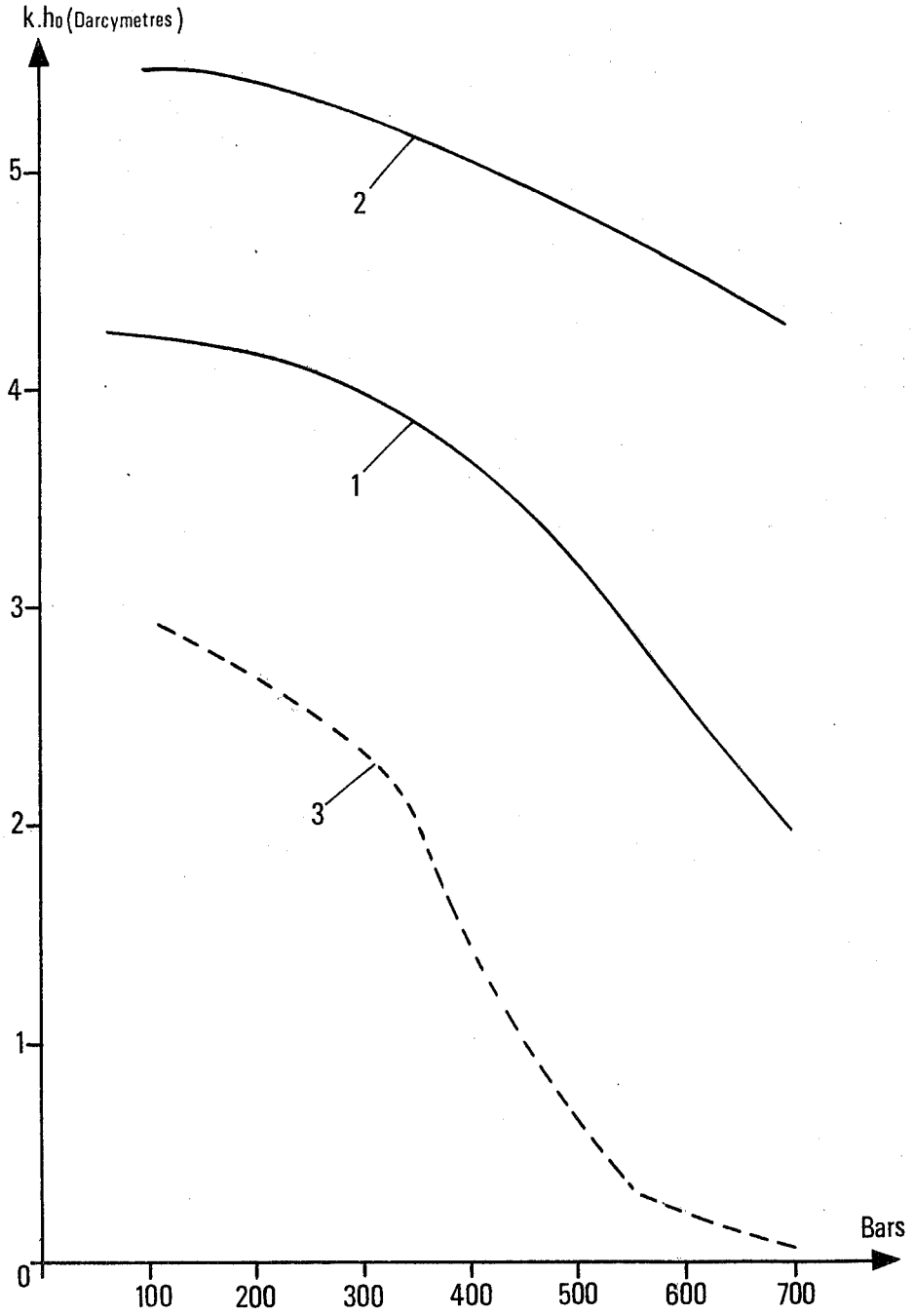

By drawing the conductivity $kh$ as a function of the effective stress $(\sigma - p)$, diagrams such as those indicated in FIG. 2, are obtained (see the accompanying diagrams).

It is calculated that, in view of the layer depth taken up by a hydraulic fracture and the general permeability of this layer, it is essential that, in order for stimulation of this layer to be successful, the ratio fracture conductivity/formation conductivity should be at least equal to 6.

As will be recalled, the conductivity is the product $kh$ of the depth $h$ (in meters) of the fracture by its permeability $k$:

$$k = \frac{uV}{\frac{dp}{dl}}$$

in which $u$ is the viscosity of the fluid flowing into the fracture, V is its flow rate and $(dp/dl)$ is the pressure gradient in the flow direction. The darcy is the normal unit of permeability.

A conductivity of 0.5 darcy meters is effectively obtained and is even largely exceeded when steel balls are used as the propping agent.

However, the injection of steel balls has various disadvantages.

Firstly, the high density of steel balls makes it necessary to place the lift of the fracturing fluid at the top of the list of operating parameters. In practical terms, it is necessary to use a liquid having a very high viscosity.

In addition, in conventional methods, the fracturing fluid and balls are injected by means of valve pumps. In the case of highly resistant materials such as steel, the wear of the valves would be very rapid and the operating costs prohibitive. This wear is considerably reduced in the case of less resistant glass balls or sand.

A more advanced method consists in injecting the steel balls into the fracturing fluid downstream of the pumps. However, this method requires very complicated equipment and is thus seldom employed.

In view of the above considerations, the injection of steel balls is employed very infrequently and the process, which is currently most generally used, is the injection of sand in preference to the injection of glass balls.

However, in the case of very deep bored wells in which the propping agents are exposed to pressures in excess of 400 bars and which may even attain or exceed 700 bars, sand and glass balls cannot be used as they are reduced to powder and do not ensure good fracture conductivity.

Even when the sand used initially possesses considerable thickness (10–15 mm), as soon as the stress exceeds 500 bars, mediocre fracture conductivities are obtained.

Glass balls are fragile owing to their lack of deformability. These balls are disposed in contact with one another at specific points and, at the very great depths in question, they are exposed to powerful stresses at these contact points which cause them to be reduced to a powder, thus considerably reducing the conductivity of the fractures.

The object of the invention is thus to provide a propping agent which enables very good fracture conductivities to be obtained even at great depths, this agent having adequate crushing resistance and a granulometry suited to the problem to be solved. The propping agent should also be simple to use and conventional devices can also be employed for this purpose.

According to the invention, a fracture propping agent is used which consists of a product in granular form containing crystallized zirconium oxide and an amorphous mineral binding agent and, more particularly, ceramic balls formed by fusion and shaped into balls and by solidification of a starting charge comprising essentially, on the basis of the oxides, up to 85% by weight zirconium oxide $ZrO_2$, silica $SiO_2$ in such proportion that the weight ratio ($ZrO_2/SiO_2$) is greater than or equal to 1.5, possibly alumina $Al_2O_3$ in such proportion that the weight ratio ($Al_2O_3/SiO_2$) is between 0 and 1.5 and possibly sodium oxide $Na_2O$ in such proportion that the weight ratio $Na_2O$ is between 0 and 0.04.

A propping agent having mechanical properties which are exceptionally well suited to the problem in question is obtained if the starting charge also contains at least one of the additional oxides MgO and CaO in such a quantity that the weight ratio ($MgO/SiO_2$) is between 0 and 1 and the weight ratio $CaO/SiO_2$ is between 0 and 1.45.

In general the $ZrO_2$ content will be at least approximately 25%.

It was unexpectedly found that the presence of at least one of the additional oxides MgO and CaO considerably improves the properties of the balls having a zirconium, silica and possibly alumina base, by comparison with balls not containing these additional oxides.

The manufacture of the balls according to the invention does not present any special difficulties. The starting charge consisting of the above-indicated oxides or of precursors of the same can be fused in an electric furnace or other fusion device known to the person skilled in the art. To convert the fused material into balls, a strip of fused material can be dispersed by blast means (for example, air or water vapor) into a multitude of particles which take on a spherical form as a result of the viscosity and surface tension. Processes of this type are currently used to manufacture commercial glass balls, (for example, see U.S. Pat. No. 3,499,745). Balls having a diameter of approximately a few tenths of a millimeter to 4 mm can thus be produced.

After cooling, the spherical particles or balls according to the invention consist of rounded, non-imbricated zirconia crystals embedded in a vitreous material formed by silica and the oxides MgO, CaO, $Al_2O_3$ and $Na_2O$, which are present.

The balls according to the invention are substantially solid (without central cavities and micro-fissures) and have a high resistance to abrasion and crushing owing to the hardness of the constituent phrases (zirconia and silica glass, improved by the added oxides) and the excellent cohesion provided by the glass which fully "steeps" the zirconia crystals.

In addition, the proposed product can be used without difficulty in the granulometry range of 10–40 mesh (ASTM standard), i.e., of 2 – 0.42 mm, which is needed to support fractures. These figures obviously do not constitute limit values.

It can be advantageous to adapt the quantity of crystallized zirconium oxide to the hardness of the geological formations which are to be supported, this quantity will increase in proportion to the hardness of the formations.

In comparison with glass balls, the material proposed according to the invention has the unexpected property of breaking, under the very powerful stresses prevailing at great depths, into coarse elements which maintain good fracture permeability, whereas the glass balls are reduced to power under these conditions, as indicated above.

However, by virtue of the special composition indicated above, it is possible to produce a propping agent which has optimum crushing resistance and is thus perfectly capable of bearing the most severe stresses which are encountered when supporting fractures at great depths.

This optimum crushing resistance is demonstrated by the following tests:

Crushing Resistance Tests

In the case of each ball composition, 20 balls are selected for their spherical shape and are subjected one by one to a crushing test between the two pistons of a press. To make possible a comparison, this test is always carried out with balls of the same diameter, i.e., 2 mm. The resistance to crushing E represents the mean value of the values obtained.

In the following test results, the percentages are by weight.

1. Balls formed solely from $SiO_2$ and $ZrO_2$:

Resistance to Crushing

The following table indicates the resistance to crushing E applicable for different quantities of $SiO_2$ where $10\% < SiO_2 \leqq 50\%$.

| $SiO_2$ | E |
|---|---|
| 10 | 40 kg/ball diameter of 2mm; |
| 15 | 60 kg/ball diameter of 2mm; |
| 20 | 65 kg/ball diameter of 2mm; |
| 30 | 80 kg/ball diameter of 2mm; |
| 40 | 90 kg/ball diameter of 2mm; |
| 50 | 60 kg/ball diameter of 2mm; |

The resistance to crushing is thus good when $SiO_2 \geqslant 15\%$.

The best crushing resistances are obtained in the range $$30\% \leqq SiO_2 \leqq 40\%$$

The compositions in which:

$$30\% < SiO_2 < 40\%$$
$$60\% \leqq ZrO_2 \leqq 70\% \text{ (with } (ZrO_2/SiO_2) \text{ ranging from 1.5 to 2.33)}$$

are most satisfactory for the following reasons:

ease of manufacture,
density and lack of micro-fissures,
resistance to crushing.

It is important to note that all these compositions can be produced from natural zircon sand ($SiO_2 \cdot ZrO_2$) containing approximately 66% $ZrO_2$ and 33% $SiO_2$(+ impurities). The use of zircon sand as the starting material for producing the balls used as the propping agent according to the invention, is economically advantageous.

2. The effect of optional oxides and additional oxides in the composition of the material used as the propping agent according to the invention.

The effect of optional and additional oxides was studied in the case of a base composition containing approximately 33% $SiO_2$ and approximately 66% $ZrO_2$ ($ZrO_2/SiO_2 = 2$), i.e., in the case of natural zircon sand, for the reason that the latter is the most economical starting material supplying zircon. The quantities of optional and additional oxides are indicated in the form of the weight ratio:

$$\frac{\text{optional or additional oxide}}{SiO_2}.$$

The quantities of optional or additional oxides (expressed as the weight ratio $$\frac{\text{optional or additional oxide}}{SiO_2})$$

indicated in reference to zircon sand also valid for the other compositions, as these oxides only modify the nature of the vitreous material.

a. Influenece of Alkaline Oxides:

The addition of alkalis does not improve the characteristics of the balls. The crushing and shock resistances are reduced and become unacceptable at a weight ratio $Na_2O/SiO_2 > 0.2$.

b. Influence of $Al_2O_3$

The range of $O < Al_2O_3/SiO_2 < 2.7$ was examined.

The external appearance of the balls is very good in the case of all the compositions. A polished face shows no signs of residual shrinkage or cracks.

X-ray analysis shows that the only crystallized phase is the monoclinical zirconia. However, mullite lines are visible in the case of $(Al_2O_3/SiO_2) > 1.5$.

Resistance to Crushing

It increases very rapidly and reaches 100kg with a small addition of alumina corresponding to the ratio $(Al_2O_3/SiO_2) = 0.1$ and then remains constant until $(Al_2O_3/SiO_2) = 0.6$.

It then decreases slowly but remains in excess of 80 kg until $(Al_2O_3/SiO_2) = 1$.

Above this point it decreases until it is lower than 60 kg when $(Al_2O_3/SiO_2) = 1.5$.

The best characteristics are obtained in the case of $0.1 < (Al_2O_3/SiO_2) < 1$.

c. Influence of MgO:

Throughout the range $0 < (MgO/SiO_2) < 1.86$, regular balls having a good external appearance are obtained.

In the case of $(MgO/SiO_2) < 1$, examination of polished faces shows that the balls are solid, without cracks and with a very fine texture.

X-ray analysis shows monoclinical zirconia as the main phase with a small amount of cubic zirconia.

The magnesium silicate is amorphous.

When $(MgO/SiO_2) > 1$, a central shrinkage cavity appears and its size increases in correspondence with the ratio $(MgO/SiO_2$.

It would appear that this fault can be linked with the formation of forsterite ($2\ MgO{\cdot}SiO_2$) precipitating at high temperatures. It was, in fact, possible to show the presence of this constituent by radiocrystallographic analysis and the concentration thereof would appear to be linked with the size of the shrinkage hole.

Resistance to Crushing

The resistance to crushing increases with the weight ratio $(MgO/SiO_2)$. It reaches a maximum when $(MgO/SiO_2) = 0.4$ and then decreases.

When $(MgO/SiO_2) \leqq 0.77$, $E > 80$kg/ ball diameter of 2 mm, (i.e., higher than the resistance of the zirconia balls not containing additional oxides).

When $(MgO/SiO_2) > 1$, this characteristic becomes unacceptable ($E < 60$ kg/ ball diameter of 2 mm).

It is possible to conclude that the addition of MgO to mixtures of $SiO_2 - ZrO_2$ improves the characteristics of the balls when $(MgO/SiO_2) \leqq 1$.

The best characteristics are obtained when $(MgO/SiO_2)$ is approximately 0.4: $E = 145$ kg/ ball diameter of 2 mm.

Influence of CaO:

In the range $O < (CaO/SiO_2) < 1.90$, regular balls having a good external appearance are obtained.

Examinations carried out on polished sections show that the balls are solid, without cracks and with fine zirconium crystallization up to $(CaO/SiO_2) = 1.5$.

Above this value, shrinkage cavities begin to appear and these widen as this ratio increases.

X-ray analyses show that the appearance of this fault corresponds to the presence of $CaO{\cdot}ZrO_2$ and crystallized silicates.

These observations have been confirmed by studying the characteristics of the balls produced.

Resistance to Crushing:

It increases with the ratio $(CaO/SiO_2)$ to reach a maximum (120 kg/ ball) when $(CaO/SiO_2) = 0.82$. It then decreases and becomes unacceptable (<60 kg) when $(CaO/SiO_2) = 1.45$.

When $(CaO/SiO_2) \leqq 1.21$, $E > 80$ kg (resistance of the spheres made of zircon not containing additional oxides).

The best characteristics are obtained with a weight ratio $(CaO/SiO_2) \sim 0.82$: $E = 120$ kgl ball diameter of 2 mm.

The addition of the oxides $Al_2O_3$, MgO, CaO, to the zircon sand (33% of $SiO_2$ - 66% zirconia produces an increase in the proportion of the vitreous bonding matrix which remains the least hard phase of the balls. In spite of this, the crushing resistance is markedly increased. This results from the improvement to the mechanical characteristics of the vitreous matrices thus formed.

Similarly, compositions having a higher zirconia content bonded by the best vitreous matrices disclosed in the preceding study, will have considerably improved characteristics. Listed hereinafter are some examples of compositions having a high zirconia content modified with additional oxides suitable for the balls used as the propping agent according to the invention. Their resistances to crushing are also indicated.

| | | |
|---|---|---|
| Composition A | $ZrO_2$ = 79% by weight<br>$SiO_2$ = 15% by weight<br>MgO = 6% by weight | E = 150 |
| Composition B | $ZrO_2$ = 76% by weight<br>$SiO_2$ = 12% by weight<br>CaO = 12% by weight | E = 130 |
| Composition C | $ZrO_2$ = 74% by weight<br>$SiO_2$ = 7% by weight<br>$Al_2O_3$ = 10% by weight | E = 150 |

The improvement to the mechanical characteristics provided by the addition of one of the oxides $Al_2O_3$, MgO and CaO continues to be present if a plurality of these oxides are simultaneously added to the vitreous phase, a portion of the CaO or MgO in the above compositions can also be replaced by MgO or CaO, respectively.

Comparative tests between Texas sand and the balls according to the invention, having the same granulometry (10–20 mesh ASTM standard), i.e., 2 - 0.84 mm, were carried out under the conditions illustrated in FIG. 1.

FIG. 2 shows the results obtained with the balls according to the invention for an initial fracture depth of $h_o = 6$ mm (curve 1) and an initial fracture depth $h_o = 10$ mm (curve 2).

The same figure shows the results obtained with Texas sand having the same granulometry in the case of an initial fracture depth $h_o$ of 10 mm (curve 3).

The superiority of the propping agent according to the invention is apparent. For example, in the case of a stress of 700 bars, the conductivity $k.h$ of the balls is, depending on the initial depth $h_o$, 2, 3 or 4 darcy meters whereas it is only 0.1 darcy meter in the case of the sand. In addition, the conductivity of the balls used according to the invention is also divided by a factor of 2 when the effective stress passes from 50 to 700 bars, whereas, under the same conditions, it is divided by a factor in excess of 10 in the case of Texas sand.

The injection of the balls according to the invention may be effected by means of the same fluids which are used to inject sand. The density of the balls is only 3.9 as compared to 7.8 in the case of steel balls.

The balls employed according to the invention, possessing in the thickness of a few millimeters, propping properties similar to those of steel, are capable, by virtue of their density, which is approximately half that of steel, of being injected in volumes double that of steel balls, which is extremely advantageous in terms of propping the maximum fracture surface area. On the other hand, the quality of the material makes it possible to use volumes at most equal to those of sand, the density of which is much lower.

In addition, the propping agent proposed according to the invention possesses the advantage over steel balls that it will not damage the valves of injection pumps and can thus be injected by means of conventional devices. This does not apply to steel balls.

These qualities of the propping agents according to the invention render this material perfectly suited for supporting fractures produced hydraulically at great depths.

It is obviously possible, without departing from the scope of the invention, to employ other propping agents, possibly conventional agents such as those indicated in the introduction, in addition to the propping agent according to the invention; the injection of these different types of propping agents into the bored well can be effected simultaneously or successively.

In certain cases it can also be advantageous to successively inject at least two different granulometries of the propping agent according to the invention, the largest granulometry being injected last in order to keep open the lips of the fractures.

What is claimed is:

1. A propping agent for fractures produced in the walls of a bored well, comprising a manufactured product in granular form containing crystallized zirconium oxide embedded in an amorphous mineral binding material, the product containing, on an oxide basis, up to 85% by weight zirconium oxide $ZrO_2$, silica $SiO_2$ in a quantity such that the weight ratio ($ZrO_2/SiO_2$) is at least equal to 1.5, a quantity of alumina $Al_2O_3$ such that the weight ratio ($Al_2O_3/SiO_2$) is from 0 to 1.5, and a quantity of sodium oxide $Na_2O$ such that the weight ratio ($Na_2O/SiO_2$) is from 0 to 0.04.

2. A propping agent as claimed in claim 1, wherein said product is in the form of balls.

3. A propping agent for fractures produced in the walls of a bored well, comprising a product in granular form which, on an oxide basis, contains up to 85% by weight zirconium oxide $ZrO_2$, silica $SiO_2$ in a quantity such that the weight ratio ($ZrO_2/SiO_2$) is at least equal to 1.5, alumina $Al_2O_3$ in a quantity such that the weight ratio ($Al_2O_3/SiO_2$) is from 0 to 1.5 and a quantity of sodium oxide $Na_2O$ such that the weight ratio ($Na_2O/SiO_2$) is from 0 to 0.4, said product further containing at least one of the oxides MgO and CaO in a quantity such that the weight ratio ($MgO/SiO_2$) is between 0 and 1 and the weight ratio ($CaO/SiO_2$) is between 0 and 1.45.

4. A propping agent as claimed in claim 3, wherein the weight ratio ($MgO/SiO_2$) is approximately 0.4.

5. A propping agent as claimed in claim 3, wherein the weight ratio ($CaO/SiO_2$) is approximately 0.82.

6. A propping agent as claimed in claim 3, wherein the weight ratio ($MgO/SiO_2$) is between 0 and 0.77, the weight ratio ($CaO/SiO_2$) is between 0 and 1.21 and the weight ratio ($Al_2O_3/SiO_2$) is between 0 and 1.

7. A propping agent as claimed in claim 3, wherein the weight ratio ($ZrO_2/SiO_2$) is between 1.5 and 2.33.

8. A propping agent as claimed in claim 3, wherein the weight ratio ($ZrO_2/SiO_2$) is approximately equal to 2.

9. A propping agent for fractures produced in the walls of a bored well, comprising a product in granular form which, on an oxide basis, contains up to 85% by weight zirconium oxide $ZrO_2$, silica $SiO_2$ in a quantity such that the weight ratio ($ZrO_2/SiO_2$) is at least equal to 1.5, a quantity of sodium oxide $Na_2O$ such that the weight ratio ($Na_2O/SiO_2$) is from 0 to 0.04, and alumina $Al_2O_3$ in a quantity such that the weight ratio ($Al_2O_3/SiO_2$) is between 0.1 and 1.

10. A method of propping open fractures produced in the walls of a bored well, comprising injecting into the well a fluid suspension of a propping agent comprising a product in granular form containing crystallized zirconium oxide embedded in an amorphous mineral binding material, the product having a composition which, on an oxide basis, comprises up to 85% by weight zirconium oxide $ZrO_2$, silica $SiO_2$ in a quantity such that the weight ratio ($ZrO_2/SiO_2$) is at least equal to 1.5, a quantity of alumina $Al_2O_3$ such that the weight ratio ($Al_2O_3/SiO_2$) is from 0 to 1.5, and a quantity of sodium oxide $Na_2O$ such that the weight ratio ($Na_2O/SiO_2$) is from 0 to 0.04.

11. A method of propping open fractures produced in the walls of a bored well as claimed in claim 10, comprising using in said fluid suspension grains of said propping agent having a zirconia content selected in dependence with the hardness of a geological formation, the zirconia content increasing in proportion to the hardness of the geological formation.

12. A method of propping open fractures as claimed in claim 10, wherein at least two different granulometries of said product are injected successively.

13. A method of propping open fractures as claimed in claim 12, wherein the largest granulometry is injected last in order to keep open the lips of the fractures.

14. A propping agent for fractures produced in the walls of a bored well, comprising a product in granular form which, on an oxide basis, consists essentially of up to 85% by weight zirconium oxide $ZrO_2$, silica $SiO_2$ in such a quantity that the weight ratio ($ZrO_2/SiO_2$) is at least equal to 1.5, aluminum oxide $Al_2O_3$ in such a quantity that the weight ratio ($Al_2O_3/SiO_2$) is from 0.1 to 1, sodium oxide $Na_2O$ in such a quantity that the weight ratio ($Na_2O/SiO_2$) is from 0 to 0.04, and at least one of the oxides MgO and CaO in a quantity such that the weight ratio ($MgO/SiO_2$) is from 0 to 1 and the weight ratio ($CaO/SiO_2$) is from 0 to 1.45.

15. A propping agent for fractures produced in the walls of a bored well, comprising a product in granular form which, on an oxide basis, consists essentially of up to 85% by weight zirconium oxide $ZrO_2$, silica $SiO_2$ in such a quantity that the weight ratio ($ZrO_2/SiO_2$) is at least equal to 1.5, aluminum oxide in such a quantity that the weight ratio ($Al_2O_3/SiO_2$) is from 0.1 to 1, sodium oxide $Na_2O$ in such a quantity that the weight ratio is from 0 to 0.04, magnesium oxide MgO in such a quantity that the weight ratio ($MgO/SiO_2$) is approximately 0.4 and, calcium oxide CaO in such a quantity that the weight ratio ($CaO/SiO_2$) is approximately 0.82.

* * * * *